US006460847B1

(12) United States Patent
Boss

(10) Patent No.: US 6,460,847 B1
(45) Date of Patent: Oct. 8, 2002

(54) SHEET FLOW DIRECTION CHANGING MECHANISM

(75) Inventor: Roland Boss, Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/884,610

(22) Filed: Jun. 18, 2001

(51) Int. Cl.[7] ..... B65H 5/00
(52) U.S. Cl. ..... 271/225; 271/184; 271/902
(58) Field of Search ..... 271/184, 185, 271/186, 225, 902

(56) References Cited

U.S. PATENT DOCUMENTS 3,948,505 A * 4/1976 Miller et al. ..... 271/902
4,078,789 A * 3/1978 Kittredge et al. ..... 271/902
4,214,740 A * 7/1980 Acquaviva ..... 271/902
4,262,895 A * 4/1981 Wenthe ..... 271/902
4,531,725 A * 7/1985 Seelen ..... 271/902
5,082,272 A * 1/1992 Xydias et al. ..... 271/902
5,310,174 A * 5/1994 Thomas ..... 271/902
5,449,164 A * 9/1995 Quesnel et al. ..... 271/902
6,244,590 B1 * 1/2001 Williams ..... 271/902
6,244,591 B1 * 6/2001 Paulat ..... 271/902

* cited by examiner

*Primary Examiner*—H. Grant Skaggs

(57) ABSTRACT

A sheet flow direction changing mechanism having a roller system comprised of three rollers and a sheet stopping device and so adapted and arranged that a sheet passing through said mechanism is (1) driven in a first direction by passing between a center roller and a top roller, (2) stopped and then (3) directed into a nip between the center roller and a bottom roller and thereby driving the sheet in a second direction.

19 Claims, 11 Drawing Sheets

SHEET FLOW DIRECTION CHANGING MECHANISM

BACKGROUND OF THE INVENTION

1. Field of the Invention

The present invention relates generally to hard copy sheet processing apparatus used in various automated business machines. More specifically, it is concerned with apparatus for quickly changing the flow direction of successive sheets of print media (such as paper) before they are fed to another workstation in that same machine, or to an altogether different machine.

2. Description of Related Art

Automated business machines for producing or reproducing hard copy documents (such as inkjet printers, electrophotographic printers, impact printers, copiers, facsimile machines, document scanners and the like) often include, or are otherwise associated with, a mechanism that changes the flow direction or path over which a sheet of print media travels through a given automated business machine. Those skilled in the automated business machine arts also will appreciate that such sheet flow direction changes are made for several reasons. For example they are often made to invert the stacking sequence of a series of sheets. This causes the first side of a first sheet to be the first or "top" side of the first printed sheet (and so on for the second, third, etc. sheets) when a stack is removed from a collection tray and turned over. Otherwise, the order of the sheets in the stack would have to be reversed. This is a time consuming operation. Sheet flow direction changes also are employed to reduce the "footprint" of a given machine—especially in a desktop working environment. Other automated business machine operations change a sheet's flow direction in order to send that sheet to an entirely different machine or to send that sheet to a sheet collection tray located inside or outside of the machine in which the sheet flow direction is changed.

SUMMARY OF THE INVENTION

The sheet flow direction changing mechanisms of this patent disclosure address the sheet turnover time and machine "footprint" problems by providing a mechanically simple, fast acting mechanism that takes less lateral space and less vertical space relative to various prior art sheet flow direction changing devices. Because of their relatively faster actions—and smaller space requirements—applicant's sheet flow direction changing mechanisms are more readily associated with various automated business machines such as inkjet printers, electrophotographic printers, impact printers, copiers, facsimile machines, document scanners and the like. These mechanisms also are characterized by their mechanical simplicity and, hence, reliability. Applicant's sheet flow direction changing mechanisms are preferably used in those automated business machines that process sheets of print media, such as sheets of paper, that are flexible in nature. Those skilled in this art will appreciate that other flexible (i.e., capable of being bent or buckled in a manner hereinafter described), sheet-like, materials (such as thin sheets of flexible polymer compositions) can be processed by the mechanisms described in this patent disclosure while other more rigid (and hence relatively inflexible) materials (such as thicker sheets of inflexible polymer compositions) may not be so readily processed.

The two most important components of applicant's sheet flow direction changing mechanism are a three roller device and a sheet flow stopping device. The three roller device is comprised of a first roller (e.g., a center roller), a second roller (e.g., a top roller) and a third roller (a bottom roller). These three rollers form first and second rolling interface contact regions hereinafter more fully described. The three roller device first operates by driving a sheet in a first flow direction (e.g., rightward) by virtue of being driven between the interface of the first roller (e.g., the center roller) and the second roller (e.g., the top roller). The sheet flow stopping device serves to stop this sheet flow in the first direction and to position the trailing edge of such a sheet with respect to another roller interface of the first roller (e.g., the center roller). This other interface is between the first roller (e.g., center roller) and a third roller (e.g., the bottom roller) of said three roller device. The trailing edge of the sheet is then fed into this other interface and thereby changing the sheet's flow direction.

The sheet flow direction changing mechanisms of this patent disclosure are particularly characterized by the fact that they are, to a very large degree, mechanical in nature. That is to say that they operate primarily through mechanically connected elements (such as linkage arms) rather than through use of electrical signals to those mechanical elements. Hence, the hereindescribed sheet flow direction changing elements are generally less complex, more reliable and less costly than those sheet flow direction changing devices that employ various electrical sensing and signaling devices to control their sheet handling components.

Optionally, the sheet flow direction changing mechanism of this patent disclosure may further comprise (1) an automated sheet flow stopping device that is mechanically operated by an incoming sheet of print media, (2) one or more sheet guide plates that mechanically direct the trailing edge of a sheet of print media into a roller nip between the center roller and the bottom roller of the three roller device of the sheet flow directing mechanism and (3) a mechanical linkage mechanism that operates a foot-like sheet stopping device in a manner that serves to fix a sheet under the foot-like sheet stopping mechanism in a position such that the trailing edge of that stopped sheet will come into friction contact with the outside surface of the center roller and thereby driving that trailing edge downward in a manner such that a sheet bends, buckles or humps in a way that is conducive to feeding the trailing edge of the sheet into a nip between the center roller and bottom roller.

Subsequent parts of this patent disclosure will demonstrate how a sheet of flexible print media such as paper will naturally unbuckle after it is driven downward and past the center roller. Such a sheet will then unbuckle in a an opposing (e.g., leftward) direction because its other side is held down by a sheet stopping device. The passage of the sheet between the center roller and bottom roller drives the sheet in a flow direction that is, to some degree, the opposite direction from that in which the sheet was driven as it passed between the center roller and top roller. In some still more preferred embodiments of this invention, applicant's sheet flow direction changer apparatus will further comprise a sheet turnover device. Since roller type sheet turnover devices are so commonly used, they will be used as the primary example of those sheet turnover or "flipping" devices for the purposes of this patent disclosure.

DETAILED DESCRIPTION OF THE INVENTION

Figure 1:
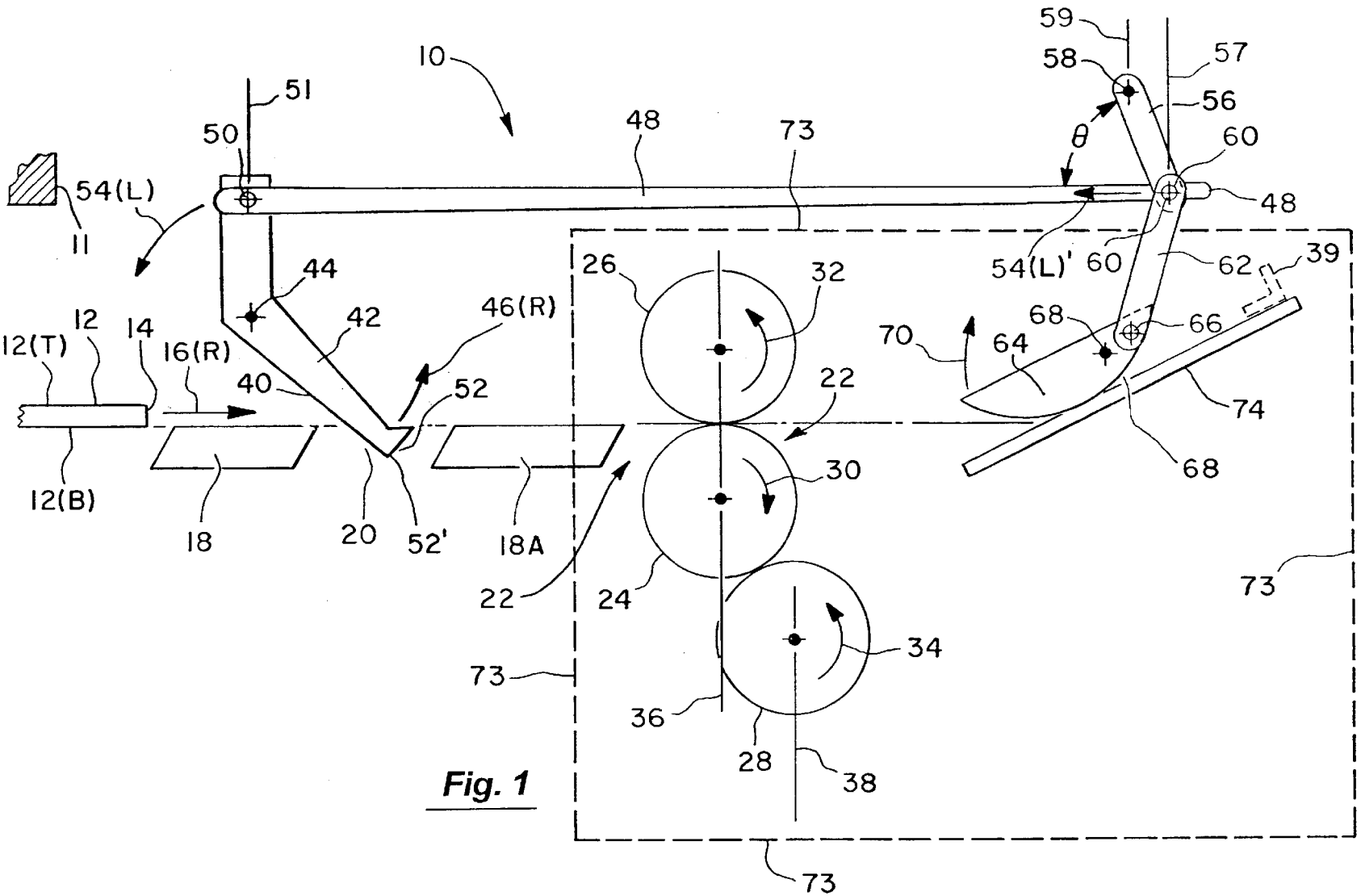
FIG. 1 is a cut-away side view of a sheet flow direction changing mechanism of this patent disclosure in a first operating position wherein an incoming sheet has not yet activated the mechanism.

FIG. 1 shows a sheet flow direction changing mechanism 10 of this patent disclosure in a first operating position wherein a sheet 12 of print media (such as a sheet of paper) having a leading edge 14 is shown entering the left side of the mechanism 10 and flowing in a first (e.g., rightward) direction 16(R). The sheet 12 flows along the top surface of a substantially horizontal first guide plate 18. A second horizontal guide plate 18A lies to the right of the first guide plate 18. A space 20 exists between the first guide plate 18 and the second guide plate 18A.

A roller device 22 is positioned to the right of the second horizontal guide plate 18A. This roller device 22 is the first essential component of the hereindescribed sheet flow direction changing mechanism 10 of this patent disclosure. It comprises a first roller, a second roller and a third roller. The first roller is a center roller such as the center roller 24 depicted in FIG. 1. It is in roller surface contact, interface, etc. with a second roller. This second roller is preferably a top roller 26 that is mounted directly above the center roller 24. The center roller 24 is likewise in roller surface contact, interface, etc. with a third roller such as the bottom roller 28 depicted in FIG. 1. It also should be appreciated that these rollers (24, 26 and 28) can be of different sizes, but in a preferred embodiment of this invention, all three of said rollers (24, 26 and 28) will have the same diameters. In any case, at least one of these three rollers is powered. In a particularly preferred embodiment of this invention the center roller 24 is powered. That is to say that in this preferred embodiment, neither the top roller 26 nor the bottom roller 28 is powered. Thus, by way of example only, FIG. 1 shows the center roller 24 powered in a manner such that it turns in a clockwise direction 30. Therefore, the top roller 26 is driven in a counterclockwise direction 32 by virtue of being in roller surface contact with the powered, clockwise turning, center roller 24. Similarly, the third or bottom roller 28 is driven in a counterclockwise direction 34 by virtue of being in roller surface contact with the powered, clockwise turning, center roller 24.

In another particularly preferred embodiment of this invention, the center roller 24 and the top roller 26 are mounted in the same vertical axis 36 while the bottom roller 28 is mounted in a vertical axis 38 that lies in a "downstream" sheet flow direction (i.e., to the right) relative to the axis 36 in which the center and top rollers 24 and 26 are mounted. This vertical axis 38 also can be thought of as being offset closer to a highly generalized sheet flow stopping device that generally serves to stop movement of a sheet in the rightward direction 16(R) and aid in feeding that sheet into a nip or rolling interface between the center roller 24 and the bottom roller 28. Thus the sheet flow stopping device generally represents the concept of stopping the rightward movement of the sheet after its trailing edge has passed through the interface between the center roller 24 and the top roller 26. Thus, such a sheet stopping device could have an "L" shape or a "V" shape and generally face the first or top interface between the center roller 24 and top roller 26 from which the rightward 16(R) moving sheet 12 will come. It is shown as item 39 in FIG. 1. In effect the leading edge of a rightward moving sheet collides with such a sheet stopping device. Such a device 39 is shown in phantom lines because it represents a generalization of those mechanical devices that can be used to stop the rightward movement of the sheet 12. Again, one such device has an "L" configuration and its positioned such that a rightward moving sheet collides with the vertical component of the L-shaped device. Such a device 39 also can be rotated, e.g., counterclockwise, and thus form a "V" shaped notch with which a rightward moving sheet collides. In one particularly preferred embodiment of this invention, however, the sheet stopping device will be a foot-like device hereinafter more fully described.

In the first operating position depicted in FIG. 1, the rightward motion 16(R) of the sheet 12 has not yet brought the leading edge 14 of said sheet 12 into contact with the lower rear side 40 of a lever arm mechanism 42. This lever arm mechanism 42 is pivotally mounted (by means of a pivot device 44 such as a pin) to an element that is not otherwise a part of the mechanism 10 shown in FIG. 1. That is to say that this element is not specifically shown attached to the pivot device 44—but rather only generally depicted by an element 11 such as a housing element. In other words, this pivot mounting 44 is attached to some component of an overall sheet flow direction changing mechanism—including its housing and other elements—that is not otherwise shown in FIG. 1. As will be seen in subsequent drawings of this patent disclosure, this pivot mounting 44 permits the lever arm mechanism 42 to be rotated in a right, upward (counterclockwise) direction generally suggested by direction arrow 46(R).

The top of the lever arm mechanism 42 is connected to a connector rod 48 by a connector 50. Preferably the connector 50 between the lever arm mechanism 42 and the connector rod 48 also is a pivot type connector such as a connector pin. This connector 50 is not attached to the housing or other element 11 previously described. Hence, the left end of the connector rod 48 is free to move to the left or right as the lever arm mechanism 42 rotates counterclockwise or clockwise. That is to say that the lever arm mechanism 42 is free to rotate about its pivot connector 44, but is not free to move laterally or vertically because it is fixed to some other element (e.g., a housing wall 11) of an overall mechanism with which the sheet flow direction mechanism 10 shown in FIG. 1 is associated.

Consequently, when the lowest part 52 of the lever arm mechanism 42 is rotated about pivot 44, in the clockwise direction 46(R) indicated, the connector rod 48 is pulled in a leftward, counterclockwise, direction generally suggested by arrow 54(L). The leftward component of the counterclockwise movement 54(L) of the top of the lever arm mechanism 42 is transmitted to the right end of the connector rod 48 as well. This mechanical arrangement is such that, as the top of the lever arm mechanism 42 moves in a leftward (counterclockwise) direction 54(L), the right end of the connector rod 48 is pulled in a leftward direction as well. Hence, the right end of the connector rod 48 is shown provided with a direction arrow labeled 54(L)'.

The right end of the rod 48 also is shown connected to two linkage arms 56 and 62. The top end of the upper linkage arm 56 is shown connected to a pivot mounting 58. This pivot mounting 58 also is connected to a component (e.g., an element such as a housing element 11) of the overall mechanism not otherwise shown in FIG. 1. In other words, the upper arm 56 is free to rotate about its pivot mounting 58, but is not free to otherwise move (e.g., laterally or vertically) since it too is connected to a fixed element such as a housing element 11 (or other component). It also should be noted that the connector rod 48 and the upper linkage arm 56 address each other at an angle θ that is less than 90° in this first operating position.

The lower end of the upper linkage arm 56 is connected to a pivot connector 60. This pivot connector 60 is also pivotally connected to the right end of the connector rod 48 and to the top end of a lower linkage arm 62. Thus, the upper linkage arm 56, connector rod 48 and lower linkage arm 62 are all pivotally connected to each other by the pivot connector 60. This pivot connector 60 is not, however, mounted to a housing 11 (or other element) to which the pivot 58 is mounted. Hence, the pivot 60 is free to move in the lateral, leftward direction 54(L)' suggested in FIG. 1. In other words, if the connector rod 48 were pulled in a leftward direction 54(L)' by the counterclockwise rotation 54(L) of the lever arm mechanism 42, the connector rod 48, and the pivot 60 connected to it, will also move leftward. The mechanical result of moving the pivot connector 60 to the left will be discussed in subsequent parts of this patent disclosure.

For the present, it will suffice to note that the lower end of the lower linkage arm 62 is pivotally connected to a sheet movement stopping device (or sheet movement inhibiting device) such as the foot-like device 64 shown in FIG. 1. It is a more specialized sheet stopping device than the generalized L sheet stopping device 39 that is also shown (in phantom lines) in FIG. 1. The function of either the generalized sheet stopping device 39, or the specialized sheet stopping device 64, is to stop the rightward 16(R) movement of the sheet 12 after it has passed through the interface between the center roller 24 and the upper roller 26. This sheet stopping device should have other attributes as well. As previously noted, such a sheet stopping device should be so located, adapted and arranged that it stops the rightwardly 16(R) moving sheet in a location such that the trailing edge of the sheet 12 is placed in friction creating contact with the center roller 24. This friction creates a force on the trailing edge of a sheet such that the sheet is bent or buckled downward (i.e., in the clockwise direction 30 of the center roller 24) in the manner generally depicted in FIG. 7. After the trailing edge of the sheet is driven out of contact with the clockwise rotating center roller 24, the buckled sheet is free to unbuckle itself.

Thus, there are two forces that serve to bring the trailing edge of the sheet from the upper nip (i.e., the nip or rolling interface between the upper roller 26 and the center roller 24) to the lower nip (i.e., the nip or rolling interface between the center roller 24 and the lower roller 28). First, there is a frictional force created on the trailing edge of the sheet by the rotating surface of the center roller 24. Second, there is a lateral force created by the sheet's tendency to straighten itself out (i.e., unbuckle itself) along the plane generally defined by the inclined plane 74. That is to say that the mechanical properties of the paper itself (or other print media) cause the sheet to straighten out (unbuckle). This unbuckling action causes the left end of the sheet of paper to move in a generally leftward direction when it is free to do so (i.e., when its trailing edge is no longer in contact with the surface of the center roller 24). The sheet can only unbuckle in a leftward direction because one of the primary functions of the sheet stopping device 64 is to fix the right side of the sheet 12. Hence, the buckled sheet can only unbuckle by movement of its left end in a leftward direction that, to a large degree, is defined by the angle of the inclined plane 74. This leftward movement causes the trailing edge of the sheet to be fed into a lower nip or interface between the center or first roller 24 and the lower or third roller 28.

It also should be understood that a sheet stopping device may be regarded as the second essential element of the sheet flow direction changing mechanism 10 of this patent disclosure. Moreover, since its main function is to stop lateral (e.g., rightward) movement of the sheet at a defined place, it could be a very simple structure such as a vertical wall, or a "L" shaped device or a "V"-shaped device whose open side faces to the left in order to collide with and stop the leading edge 14 of a rightwardly 16(R) moving sheet 12. It might also be noted here that the bottom 76 of the foot-like device 64 shown in FIG. 1, in conjunction with the top surface of the inclined plane 74, forms a leftwardly open "V"-shaped device. Thus the leading edge 14 of a rightwardly 16(R) moving sheet 12 will collide with a vertical wall type sheet stopping device, or a leftwardly opened V-shaped sheet stopping device or be directed into the leftwardly open V formed by the bottom 76 of the foot-like device 64 and the inclined plane 74—and then be fixed there. With the sheet so fixed, its left end is (in the manner generally depicted in FIG. 7) buckled downward by the downward force placed on the left end of the sheet by the clockwise turning of the center roller 24. After the trailing edge of the sheet is driven downward and out of contact with the center roller 24, the sheet is free to unbuckle in a manner such that the left end of said sheet moves leftward and, hence, fed into a second or lower nip between the center roller 24 and the lower roller 28.

In some of the more preferred embodiments of this invention, the sheet stopping device will be capable of additional mechanical motions that facilitate rapid feeding of successive sheets through the sheet flow direction changing mechanism 10. Again, FIG. 1 shows one especially preferred sheet stopping mechanism in the form of a foot-like sheet stopper 64. It is capable of certain hereinafter more fully described mechanical movements by virtue of its connection with a pivot and linkage arm system. The foot-like device 64 is provided with a pivot connector 66 and a pivot mounting 68. It also should be noted that this foot-like device 64 is pivotally mounted to another component (such as a housing 11) that is not a part of the mechanism emphasized in these drawings. Thus, the foot-like device is capable of rotating about its pivot mounting 68 in the clockwise direction 70 depicted in FIG. 1. As will be seen in other drawings of this patent disclosure, this clockwise rotation 70 of the left or "toe" end of the foot-like device 64 will result when the right or "ankle" end of the foot-like device is subjected to a downward force delivered to the connector 66 by the lower linkage arm 62. It also should be noted that, in the first operating position depicted in FIG. 1, the foot-like device 64 is shown resting on the top surface of an inclined plane 74. Since the three roller, sheet flow directing mechanism 22 (comprised of rollers 24, 26 and 28) and some form of sheet stopping device 39, 64, etc. are the two essential elements of applicant's sheet flow direction changing mechanism, they are shown surrounded by a dotted line frame 73. These two elements (22 and 39) could, in and of themselves, carry out the sheet flow direction changing function of this invention. Consequently, the various other components of the mechanism 10 shown in FIG. 1 may be regarded as being auxiliary components to the sheet flow direction changing mechanism defined by the three roller sheet flow directing mechanism 22 and a sheet stopper device.

Figure 2:
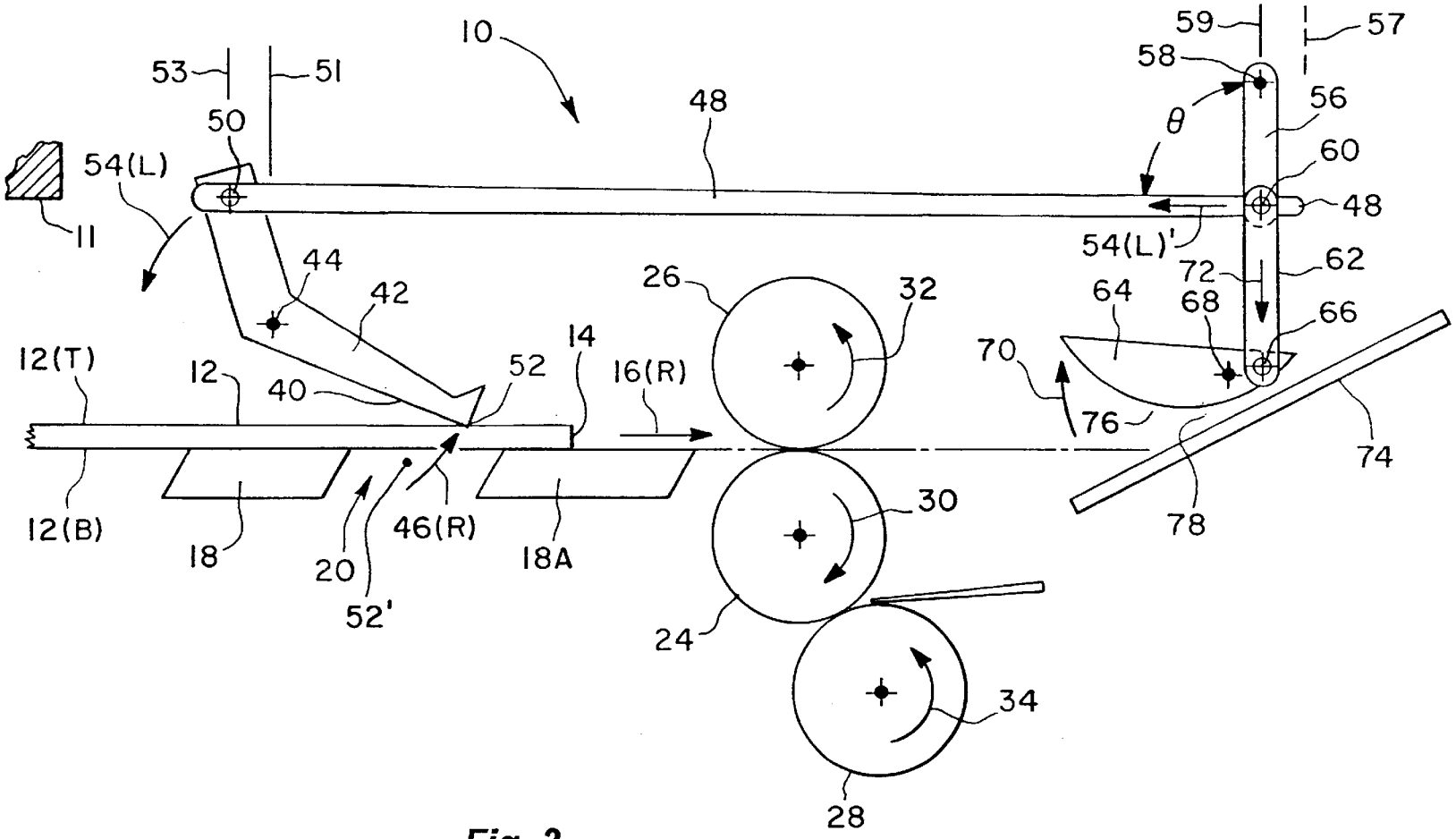
FIG. 2 is a cut-away side view of the sheet flow direction changing mechanism of the present patent disclosure in a second operating position wherein an incoming sheet has rotated a lever arm mechanism 42.

FIG. 2 depicts the sheet flow direction changing mechanism 10 of this patent disclosure in its second operating position. FIG. 2 does not show the generalized sheet stopping device 39 shown in FIG. 1, but rather concentrates on the more preferred, foot-like, sheet stopping device 64. In any case, to achieve this second operating position, the leading edge 14 of the rightwardly 16(R) advancing sheet 12 has bridged the gap 20 between the first horizontal guide plate 18 and the second horizontal guide plate 18A. In doing this, the sheet 12 collides with, and raises, a lower rear portion 40 of the lever arm mechanism 42. This action also can be regarded as a clockwise rotation 46(R) of the lower end of the lever arm mechanism 42 about its pivot mounting 44. Thus, the sheet 12 lifts the lowest point 52 of the lever arm mechanism 42 from its lowest position 52' to its highest position. In some of the more preferred embodiments of this invention, this highest position is determined wholly by the thickness of the sheet 12 passing under the lever arm mechanism 42.

Again, counterclockwise rotation 46(R) of the bottom of the lever arm mechanism 42 about fixed pivot point 44 also implies counterclockwise rotation 54(L) of the top of the lever arm mechanism 42. Since the top of the lever arm mechanism 42 is connected (preferably pivotally connected) to the connector rod 48 by a connector 50 (e.g., a pin) that is not otherwise mounted (e.g., to the housing 11), the connector rod 48 is pulled to the left. This leftward movement of the connector rod 48 also can be regarded as a leftward movement of the connector 50 from its original position 51 (see also FIG. 1) to its new, leftward position 53 (see FIG. 2).

The leftward movement 54(L)' of the connector rod 48 also pulls the pivot 60 (which is attached to the connector rod 48) to the left. Since the lower end of the upper linkage arm 56 also is connected (e.g., pivotally connected) to the connector 60 (and hence to the rod 48), it too is pulled to the left. In effect, the bottom end of the linkage arm 56 is rotated in a clockwise direction about the pivot mounting 58 located at the upper end of the linkage arm 56. Again, this pivot 58 is mounted to a device (e.g., housing 11) that is extraneous to the mechanism 10 emphasized in FIG. 2. Hence, only the lower end of the upper linkage arm 56 is free to move leftward. In FIG. 2, this leftward movement also can be regarded as the leftward movement 54(L) of pivot 60 from a first position 57 (see FIG. 1) to a second position 59. The distance between the first position 57 and the second position 59 of the pivot 60 will approximate the distance between the first position 51 and the second position 53 of the pivot 50 shown on the left side of the connector rod 48. It also should be noted that in this second operating position, the linkage arm 56 is shown in a substantially vertical orientation. That is to say that the angle θ between the connector rod 48 and the upper linkage arm is about 90° when this sheet flow direction changing mechanism 10 is in its second operating position.

The top of the lower linkage arm 62 is also connected to the pivot 60 (and hence to the connector rod 48). Hence, it too is urged to the left when the connector rod 48 is urged to the left. The bottom of the lower linkage arm 62 is connected (preferably, pivotally connected) to the right end of the sheet stopper device 64. Again, in some of the more preferred embodiments of this patent disclosure, this sheet stopper device 64 has a "foot-like" appearance. Hence, applicant will continue to refer to this embodiment of a sheet stopper device as a "foot" or foot-like device. Using this "foot" analogy, the lower end of the lower linkage arm 62 is connected (preferably pivotally connected) to the right or "ankle" portion of the foot 64. Thus, the left or "toe" end of the foot 64 is rotated in the upward and clockwise direction generally depicted by arrow 70 when the right or ankle part of the foot 64 is forced downward. This downward force is generally depicted by the downwardly directed arrow 72 in the lower linkage arm 62. In effect, this downward force 72 rotates the ankle side of the foot 64 in a clockwise direction about its pivot mounting 68. In other words, both the ankle end and the toe end of the foot 64 rotate about the pivot 68 that mounts the foot 64 to a fixed external element such as a housing 11.

This downward force 72 is produced when the top of the lower linkage arm 62 is pulled to the left by the leftward movement of the connector rod 48. Again, rotation of the foot 64 about its pivot mounting 68 raises the bottom surface 76 of said foot 64 out of physical contact with the upwardly inclined plane 74. In effect a gap 78 is created between the bottom 76 of the foot 64 and the inclined plane 74. This gap 78 is preferably wide enough to pass the rightwardly moving 16(R) sheet 12 when said sheet is directed into the gap 78. In some of the more preferred embodiments of this invention, this gap 78 should be wide enough to pass two sheets when it is the upwardly lifted position depicted in FIG. 2.

Figure 3:
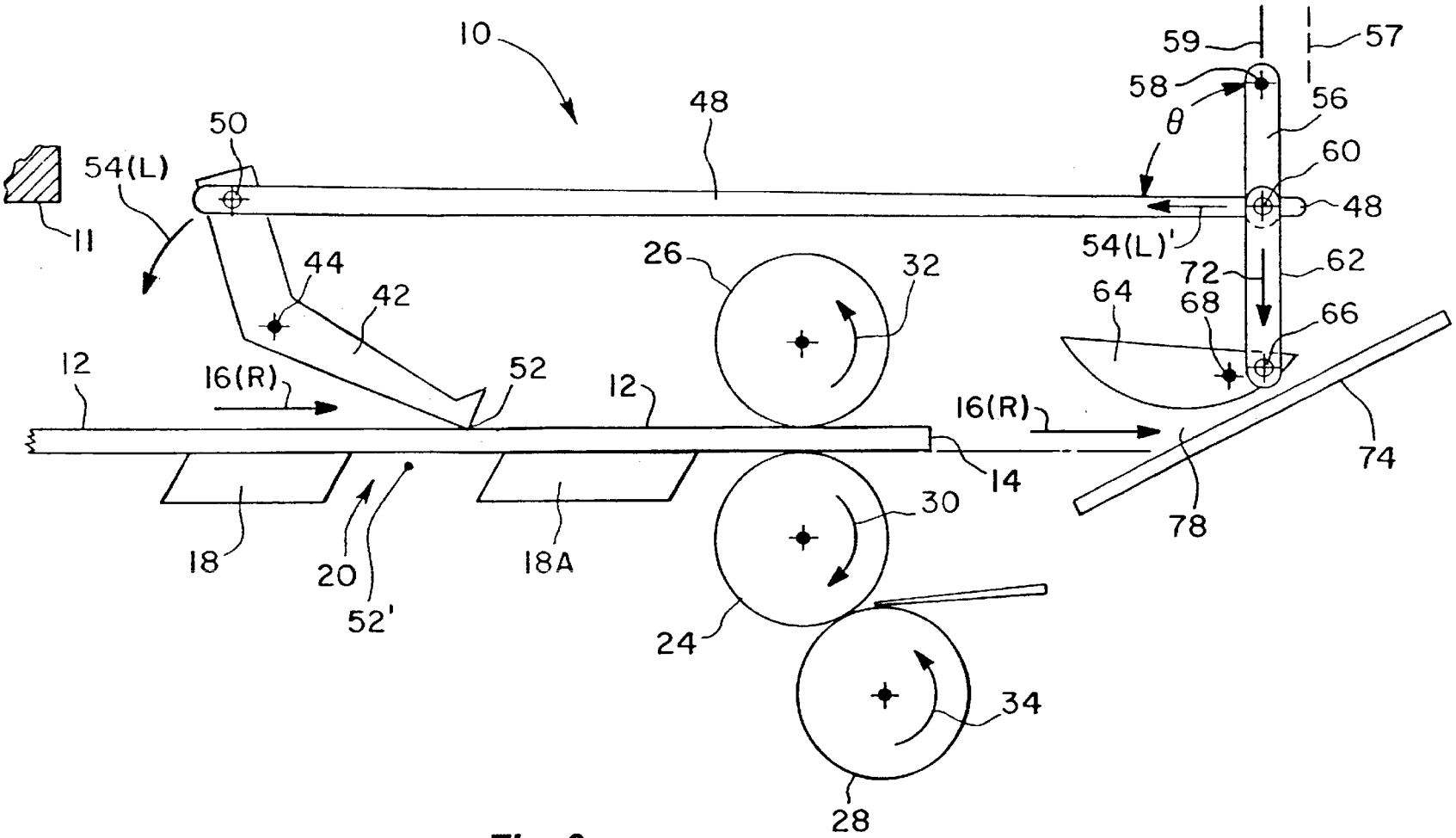
FIG. 3 is a cut-away side view of the sheet flow direction changing mechanism of this patent disclosure in a third operating position wherein the sheet is passing through the interface of a center roller 24 and a top roller 26.

FIG. 3 depicts the further progress (i.e., rightward 16(R) movement) of the sheet 12 through the sheet flow direction changing mechanism 10. In it, sheet 12 is shown moving between a first or upper interface between center roller 24 and top roller 26. Thus, the clockwise rotation 30 of center roller 24 drives the sheet in a rightward 16(R) direction. This perpetuates the counterclockwise rotation 32 of top roller 26 even though it is not in direct contact with the center roller 24.

Figure 4:
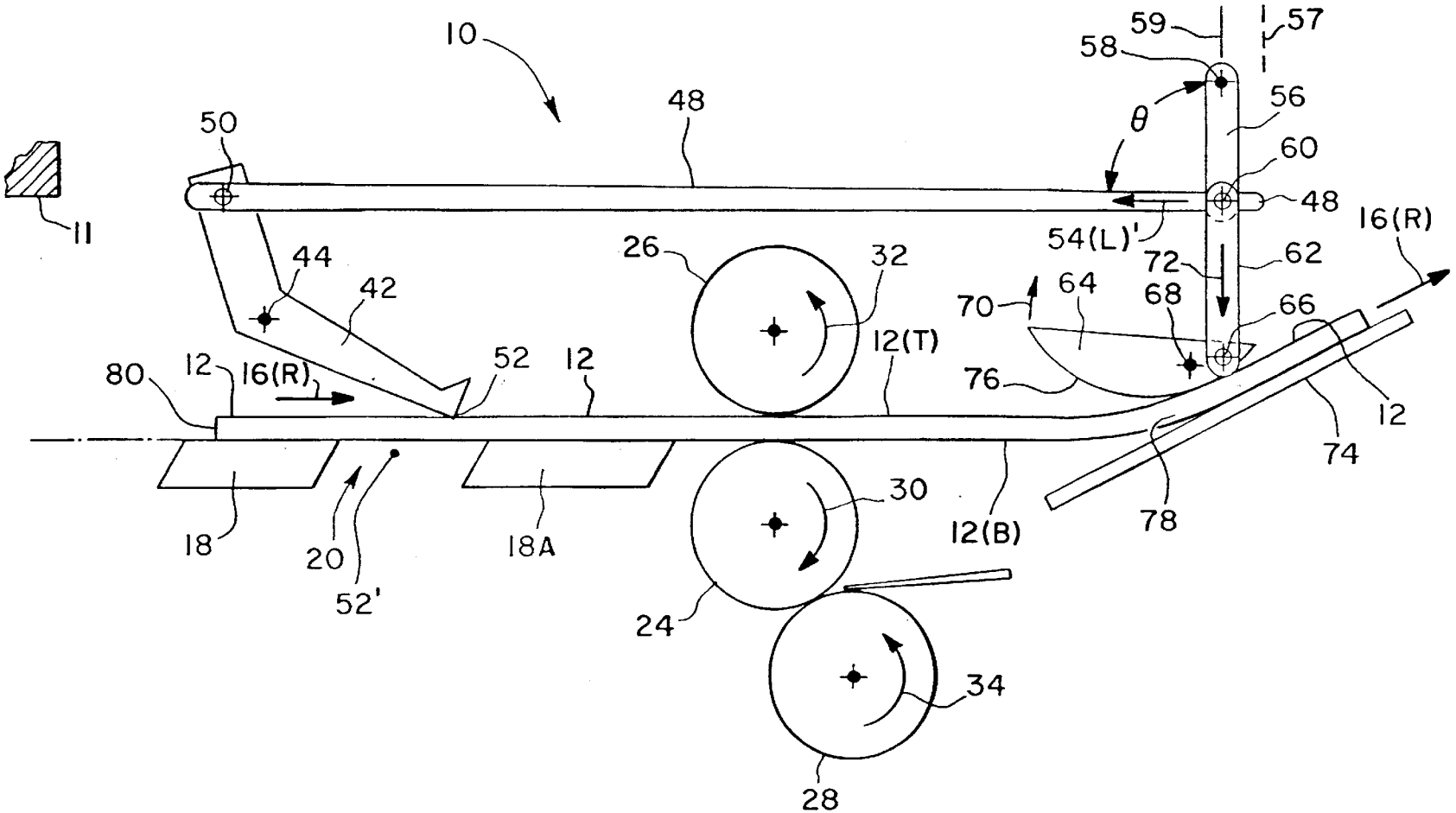
FIG. 4 is a cut-away side view of the sheet flow direction changing mechanism of this patent disclosure in a fourth operating position wherein the sheet has made contact with a preferred sheet stopping device 64.

FIG. 4 depicts the forwardly moving 16(R) sheet 12 passing between the gap 78 between the bottom 76 of the foot 64 and the top of the inclined plane 74. Again, this gap 78 is produced when the downward force 72 delivered by the lower linkage arm 62 to the ankle of the foot-like stopper device raises its toe end in the direction generally suggested by direction arrow 70. In order to do this, the lower linkage arm 62 is pulled to a vertical orientation by the leftward 54(L)' movement of the connector rod 48.

Figure 5:
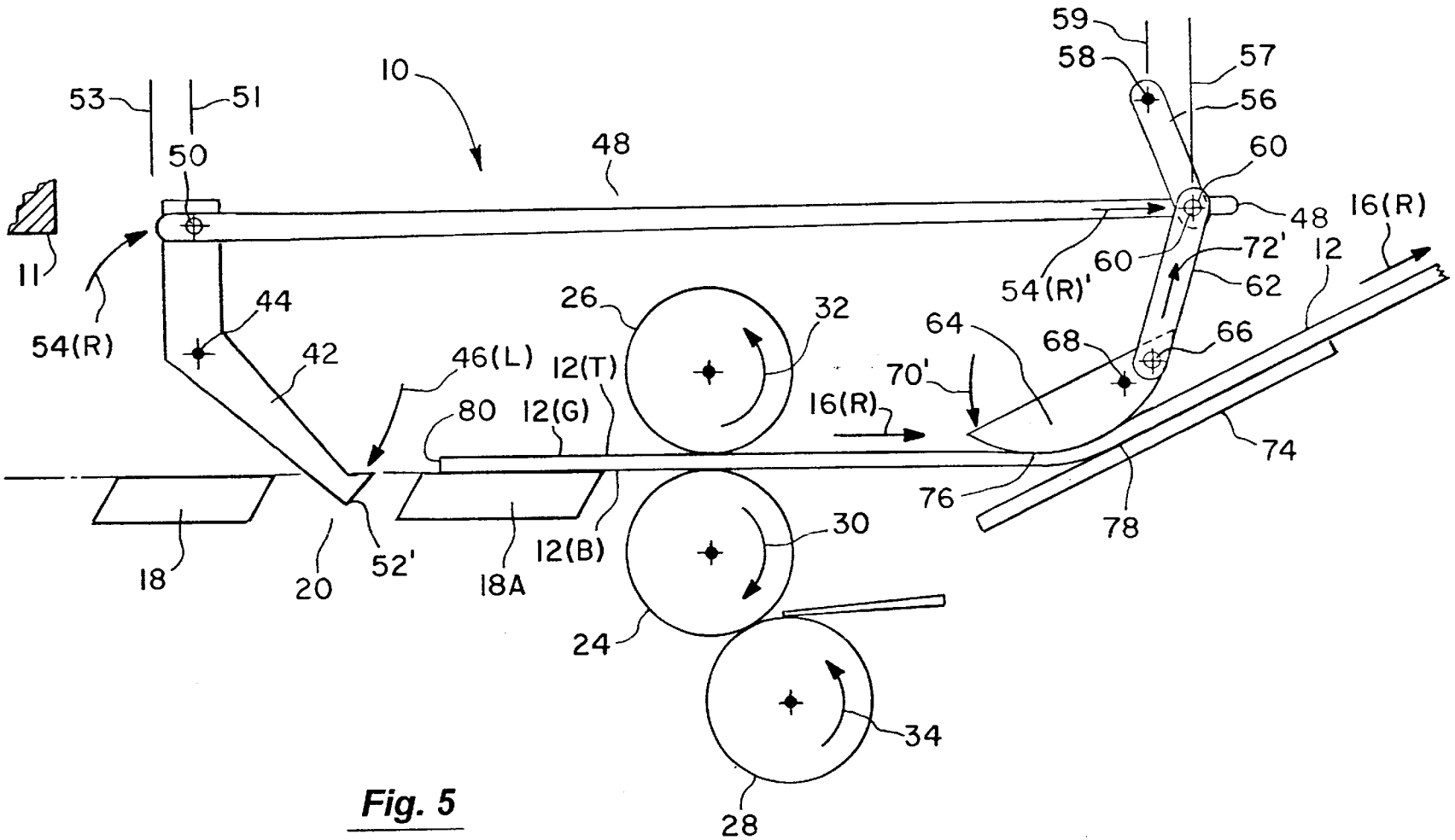
FIG. 5 is a cut-away side view of the sheet flow direction changing mechanism in a fifth operating position wherein the lever arm mechanism 42 has fallen downward by virtue of not being in contact with an underlying sheet.

FIG. 5 shows the still further progress of the sheet 12 through the sheet flow direction changing mechanism 10. In it, more of the sheet 12 is shown moved up the inclined plane 74. FIG. 5 also shows the trailing edge 80 of the sheet 12 having passed beyond the space 20 between the first horizontal guide plate 18 and the second horizontal guide plate 18A. That is to say that the space 20 between these two plates 18 and 18A is no longer bridged by a sheet as it is in FIGS. 2, 3 and 4. Hence, the lowest point 52 on the lever arm mechanism 42 is again free to fall to a lower position 52'. That is to say that the lower end of the lever arm mechanism 42 rotates in the downward and clockwise direction generally suggested by direction arrow 46(L) until it reaches point 52'. Again, since the lever arm mechanism 42 is pivotally mounted to an extraneous device (e.g., housing 11), the upper end of said lever arm mechanism 42 rotates in the upward and generally clockwise direction suggested by direction arrow 54(R). Consequently, the connector arm 48 moves in a rightward direction 54(R)' as well. This action causes the pivot 60 to move from its second position 59 to its original position 57. This, in turn, causes a generally upward and rightward force 72' on the lower linkage arm 62. This causes the toe region of the foot 64 to be rotated downward and in the generally counterclockwise direction suggested by arrow 70'. Consequently, the bottom 76 surface of the foot 64 is placed in contact with the top surface 12(T) of sheet 12.

Figure 6:
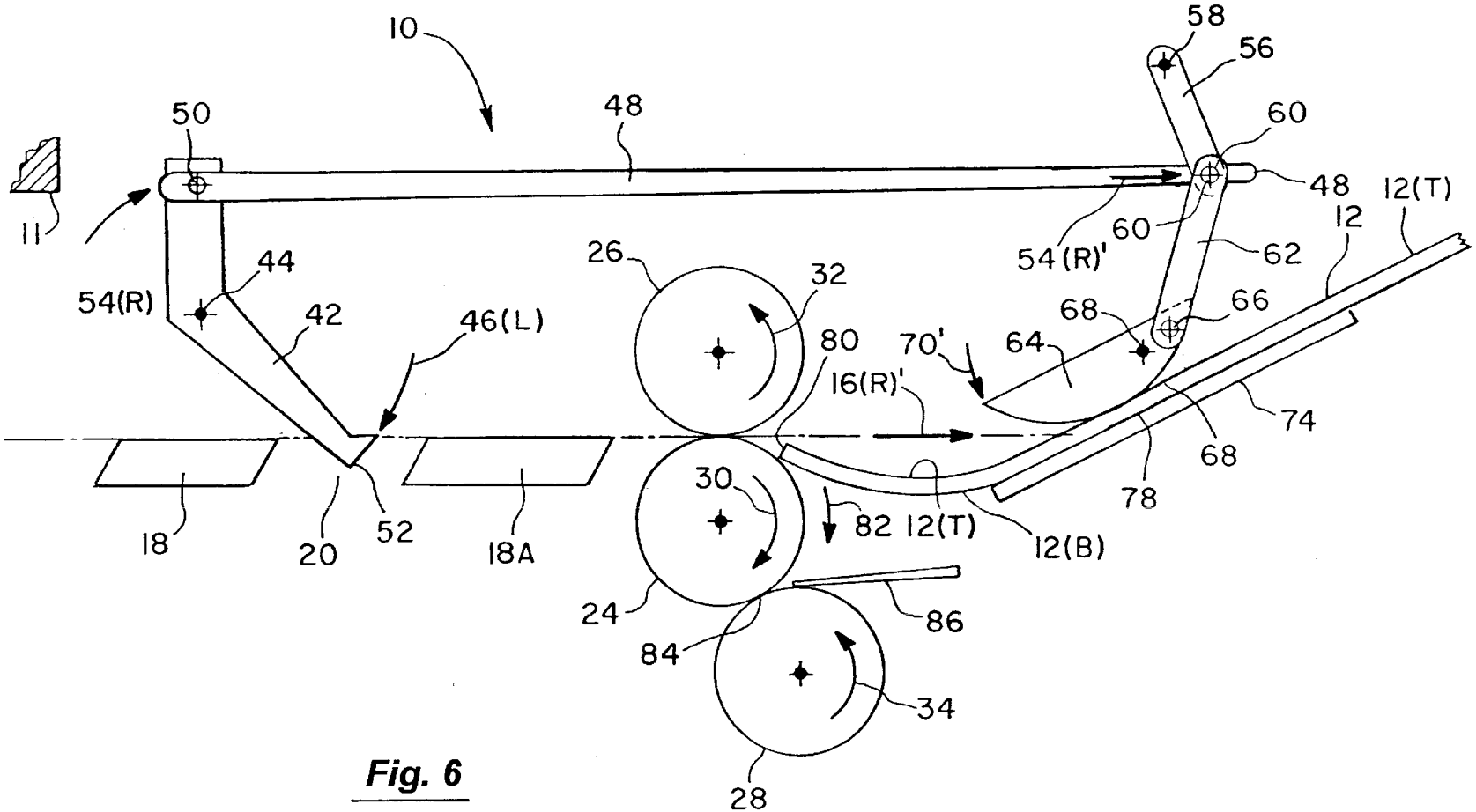
FIG. 6 is a cut-away side view of the sheet flow direction changing mechanism in a sixth operating position wherein the trailing edge 80 of a sheet has cleared the interface between the center roller 24 and the top roller 26.

FIG. 6 depicts the operation of the sheet flow direction changing mechanism 10 just after the trailing edge 80 of the sheet 12 has passed between the center roller 24 and top roller 26. In some of the more preferred embodiments of this invention, the trailing edge 80 of the sheet will be leaving the center roller 24/top roller 26 interface just as the foot 64 is coming into its full contact with the top 12(T) of the sheet 12. In this situation the rightward movement of the sheet 12 will be stopped by virtue of the bottom 76 of the foot 64 being lowered into downwardly pressing contact with the top 12(T) of the sheet 12. In this operating position, a lower region of the trailing edge 80 of sheet 12 is placed in a friction creating contact with the clockwise 30 turning roller surface of the center roller 24. This friction creating contact causes the trailing edge 80 of the sheet 12 and the surface of the center roller 24 of the sheet 12 to be "bent" or "buckled" in the downward direction suggested by direction arrow 82. The resulting downward movement of the trailing edge 80 of the sheet 12—in conjunction with the unbuckling of the sheet after its trailing edge 80 is no longer in contact with the surface of the center roller 24—will eventually direct and feed the trailing edge 80 of the sheet 12 into a nip 84 created by the rolling contact between the clockwise 30 turning center roller 24 and the counterclockwise 34 turning bottom roller 28. This feeding action into the nip 84 can be aided by the presence of a nip guide plate 86 that is so adapted and arranged that it retards the downward motion 82 of the trailing edge 80 of the sheet and directs it into the nip 84.

Figure 7:
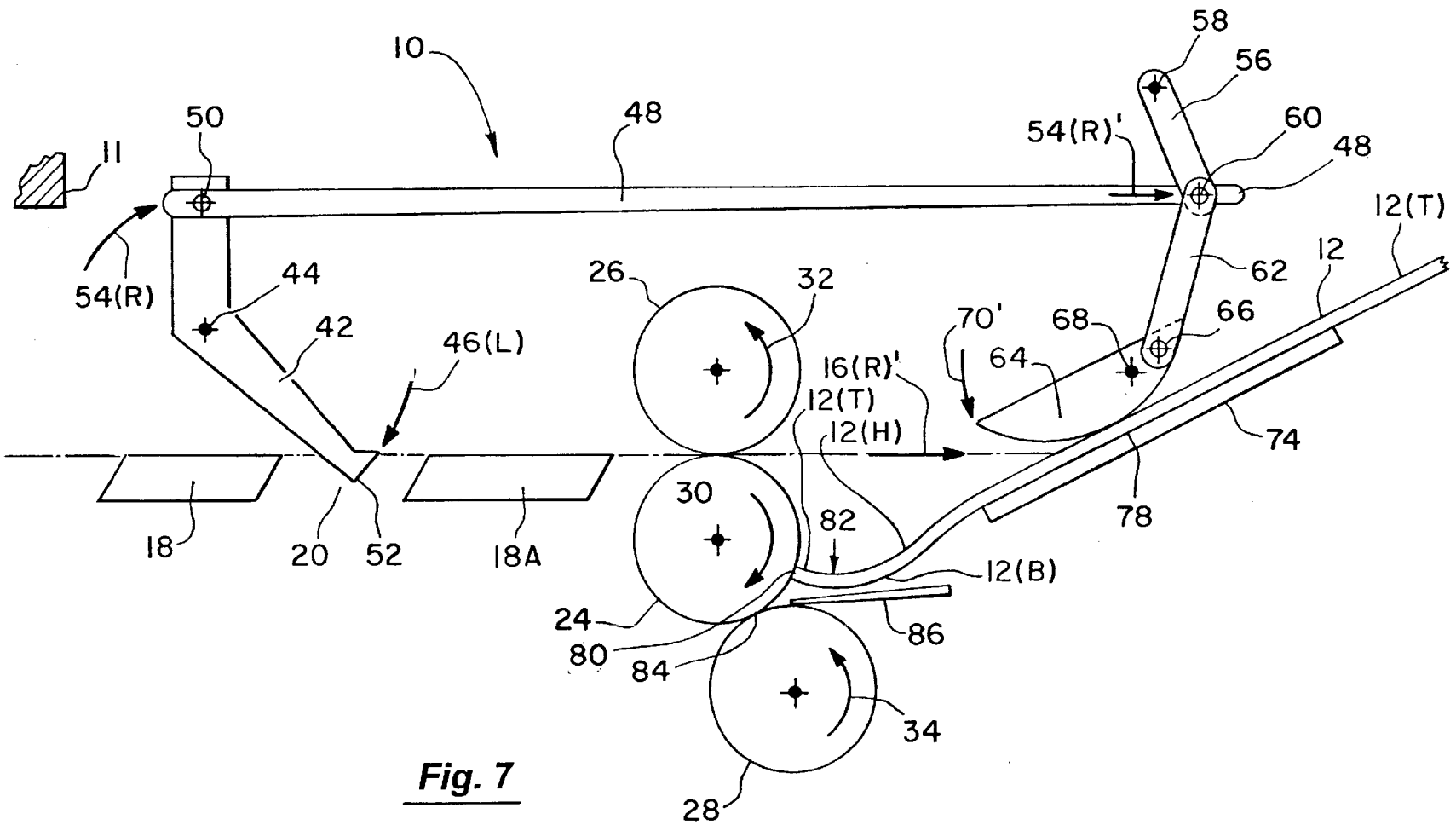
FIG. 7 is a cut-away side view of the sheet flow direction changing mechanism in a seventh operating position wherein the sheet has been buckled by virtue of having its trailing edge 80 driven over the surface of the rotating center roller 24 while its right side is held down by a sheet stopper mechanism 64.

FIG. 7 depicts the further operation of the sheet flow direction changing mechanism 10 as the trailing edge 80 of the sheet 12 is driven over the outer surface of the center roller 24. The trailing edge 80/roller 24 contact causes the sheet to be momentarily buckled into the humped configuration 12(H) shown in FIG. 7. This humped configuration 12(H) also results from the fact that a right side region of the sheet 12 is held down against the inclined plane 74 by the sheet stopping device 64. This humped configuration also represents a storage of mechanical energy in the paper material itself. Since the sheet 12 is fixed in place on its right side by the foot 64 shown in FIG. 7, the sheet 12 can only unbuckle or unhump itself by a leftward movement of the sheet's leading edge 80. Thus, as the sheet's trailing edge 80 is driven further in the downward direction 82, it passes out of contact with the outer surface center roller 24. In this circumstance the sheet 12 is then able to unbuckle or unhump itself by movement of its leftward or trailing edge 80 to the left after it is out of contact with the center roller 24.

Figure 8:
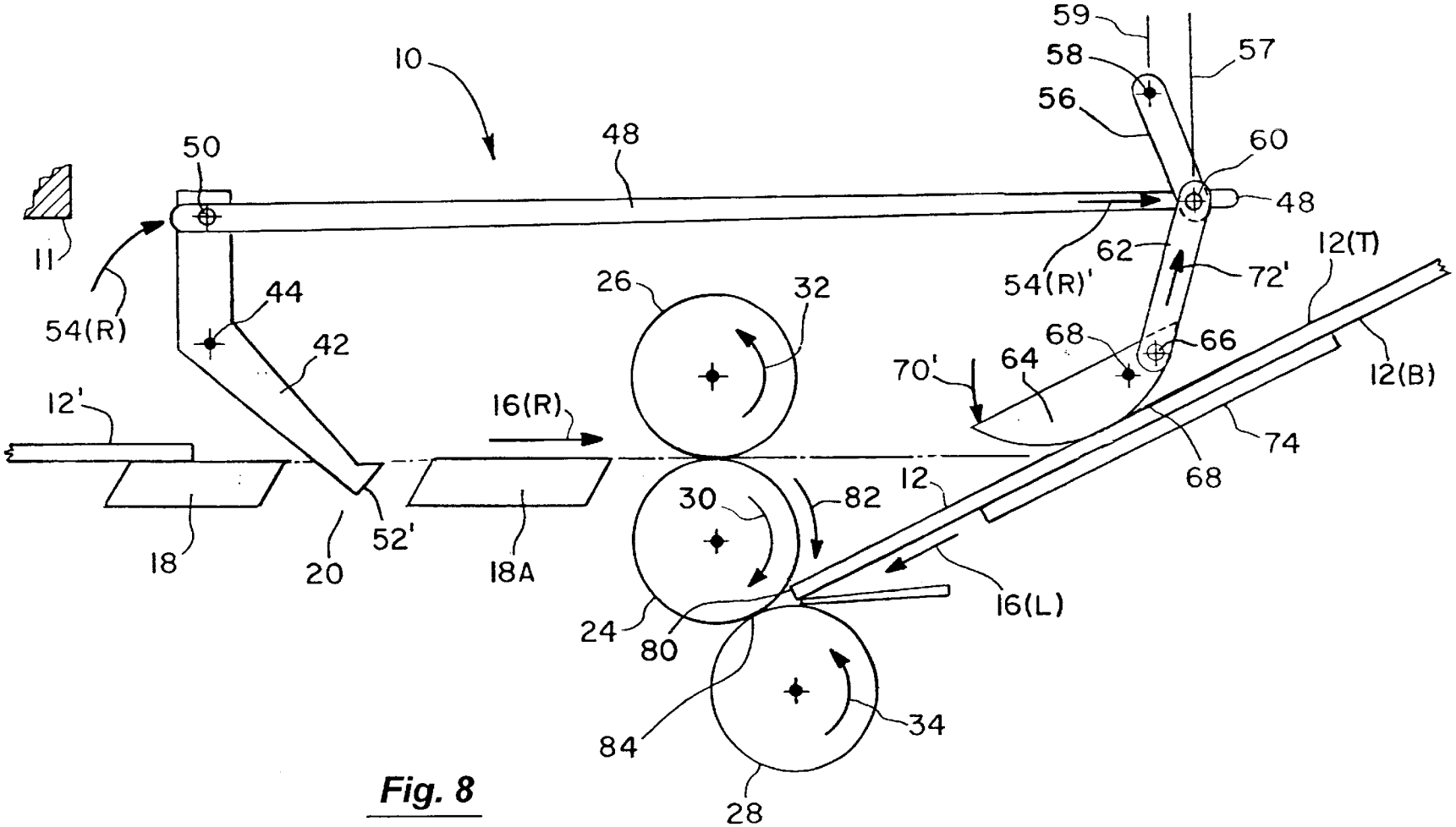
FIG. 8 is a cut-away side view of the sheet flow direction changing mechanism in an operating position wherein the sheet has unbuckled and is about to be driven into an interface between the center roller 24 and the bottom roller 28.

FIG. 8 depicts the trailing edge 80 of the sheet 12 about to enter the nip 84 between the clockwise 30 rotating center roller 24 and the counterclockwise 34 rotating bottom roller 28. It should be specifically noted that once the trailing edge 80 of sheet 12 is caught in the nip 84, said sheet 12 will commence to move in a leftward direction generally indicated by direction arrow 16(L). This leftward direction 16(L) is different from and, to some degree, generally the opposite of, the rightward motion 16(R) of the sheet 12 when it first entered into the sheet flow direction changing mechanism 10 (see FIGS. 1 through 5).

It might also be noted here that entry of a second sheet 12' into the sheet flow direction changing mechanism 10 can be initiated in many ways already well known to those skilled in this art. For example, the presence of the leading edge (trailing edge, etc.) of a first sheet 12 be sensed at any appropriate place in the mechanism 10 and converted into an electrical signal that controls the entry of a second sheet 12' into such a mechanism 10. In one particularly preferred embodiment of this invention, the leading edge 80 is sensed in a region near the nip 84 in order to direct entry of a second sheet 12' into the sheet flow direction changing mechanism 10. It might also be noted in passing here that this action is one that is electromechanical in nature rather than completely mechanical.

Figure 9:
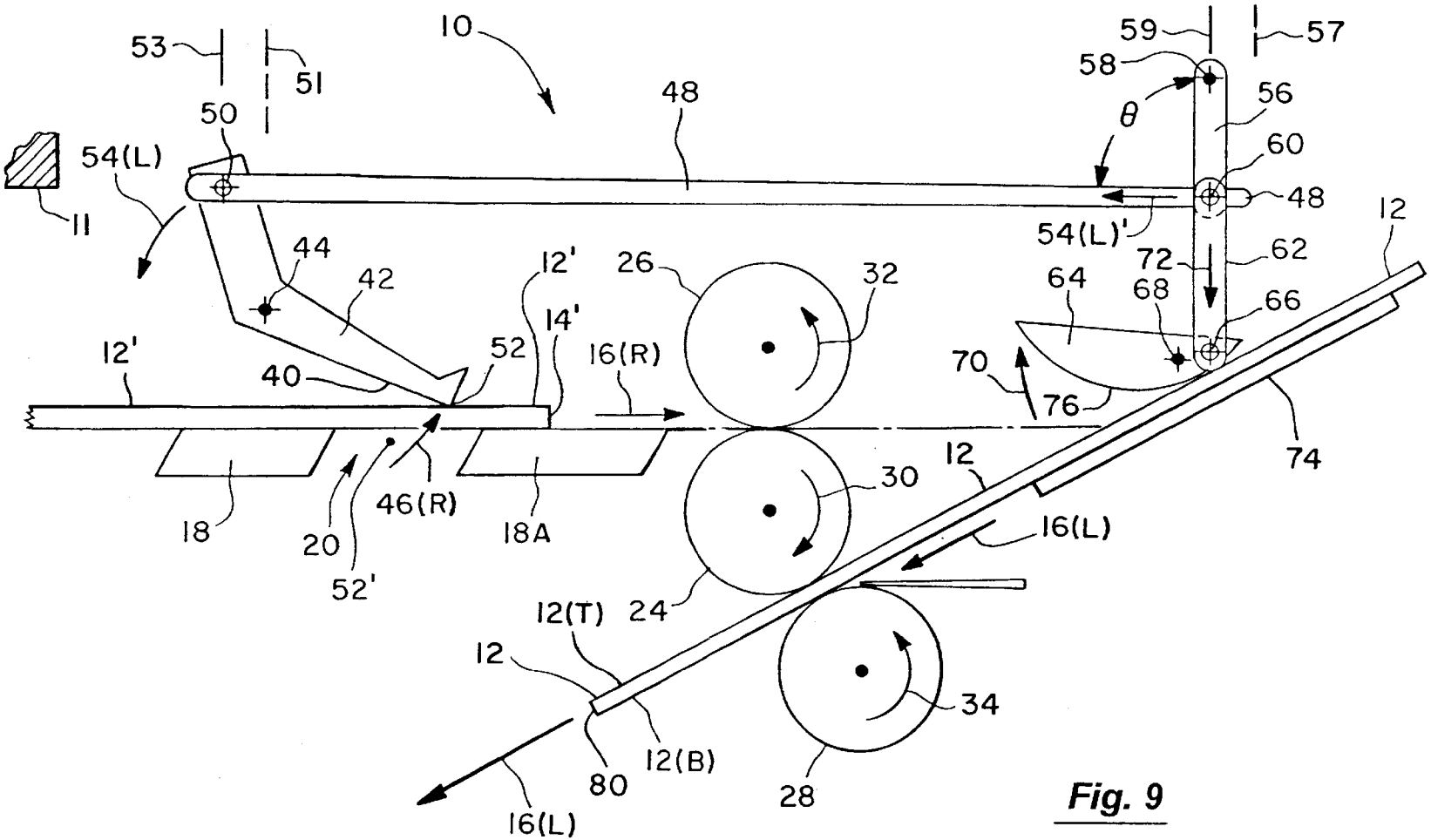
FIG. 9 is a cut-away side view of the sheet flow direction changing mechanism in an operating position wherein the sheet is being driven between an interface between the center roller 24 and the bottom roller 28.

FIG. 9 shows sheet 12 passing through the roller 24/roller 28 interface in the generally leftward direction suggested by arrow 16(L). Thus, the direction of the sheet flow has been changed from a generally rightward 16(R) direction to a generally leftward 16(L) direction. The former trailing edge 80 in the rightward 16(R) movement of the sheet 12 is now the "leading edge" in this leftward 16(L) movement of said sheet. Again, this sheet direction changing capability can have great practical value. For example, it can be employed to reduce the "footprint" of the sheet flow direction changing mechanism 10 and/or other sheet handling device associated with said mechanism 10 (e.g., inkjet printers, electrophotographic printers, impact printers, copiers, facsimile machines, scanners and so on).

FIG. 9 also shows a second sheet 12' having entered the sheet flow direction changing mechanism 10 and having bridged the space 20 between the first horizontal guide 18 and the second horizontal guide 18A during the rightward 16(R) course of its travels. Thus, at least two sheets are being processed in the mechanism 10 at the same time. This circumstance implies faster sheet processing times relative to those sheet flow direction changing devices wherein a first sheet must pass completely through the device before a second sheet enters it. Be that as it may, the lever arm mechanism 42 shown in FIG. 9 is again raised so that the sheet flow direction changing mechanism 10 is once again in its second operating position. But for the fact that two sheets (12 and 12') are being processed, the second operating position depicted in FIG. 9 is generally the same as the second operating position depicted in FIGS. 2, 3 and 4. That is to say that the second raising of the lever arm mechanism 42 engenders the same mechanical actions described with respect to said FIGS. 2, 3 and 4.

Figure 10:
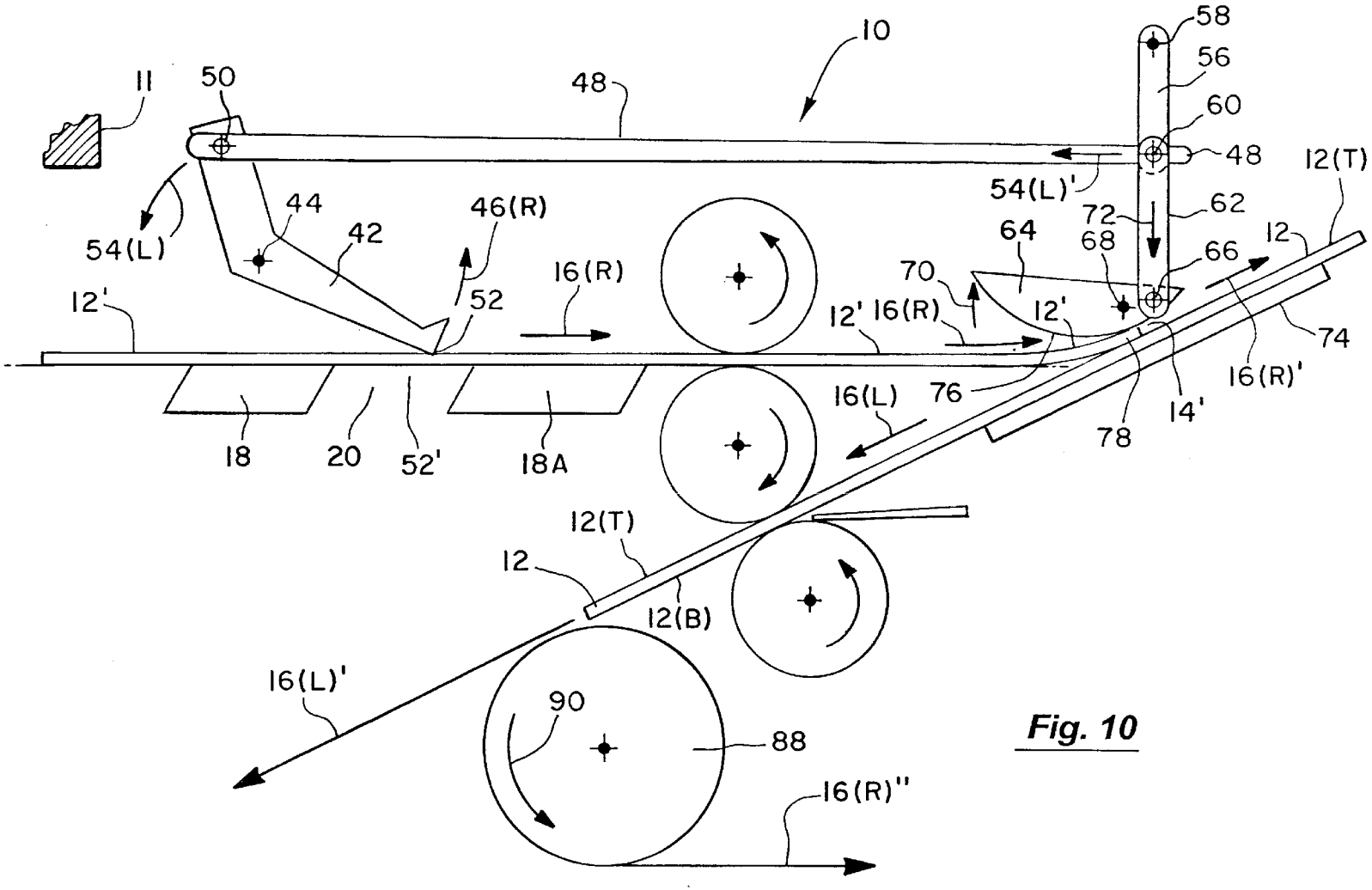
FIG. 10 is a cut-away side view of the sheet flow direction changing mechanism in an operating position wherein said mechanism is further provided with a sheet turnover device.

FIG. 10 depicts the results of the second sheet 12' passing between the center roller 24 and the top roller, colliding with the downwardly inclined top surface 12(T) of sheet 12 and generally passing into the top part of the gap 78 between the bottom 76 of the foot 64 and the inclined plane 74. The second sheet 12' continues on through the gap 78 in the upward and rightward direction generally suggested by arrow 16(R)'. Thus, in the more preferred embodiments of this patent disclosure the gap 78 between the bottom 76 of the foot 64 and the inclined plane 74 will be able to accommodate two sheets. Indeed, it will be able to simultaneously accommodate an upwardly moving 16(R) second sheet 12' and a downwardly moving 16(L) first sheet 12. This circumstance not only serves to increase the operating speed of the mechanism 10, it also serves to shorten the overall width of the sheet flow direction changing mechanism 10—and hence its "footprint" —or the footprint of a business machine with which it is associated.

FIG. 10 also shows a powered roller 88 turning in a counterclockwise direction 90. Those skilled will appreciate this powered roller 88 can symbolize many devices known to those skilled in this art that are capable of turning over or "flipping" a sheet such as a sheet of print media (especially a sheet of paper). Thus, in addition to providing a mechanism for changing the flow direction of a sheet, the sheet flow direction changing mechanism 10 of this patent disclosure can be further provided with a device 88 for turning that sheet over once its flow direction has been changed (e.g., from flow direction 16(R) to flow direction 16(L)). The extended flow direction line 16(L)' depicted in FIG. 10 is intended to depict another embodiment of this invention wherein the sheet 12 can (by means of flow direction devices such as guide gates—not shown) be guided linearly in flow direction 16(L)', or be flipped over by use of a sheet turnover device 88. The roller versions of such sheet turnover devices 88 will turn the sheet over so that its top side 12(T) becomes its bottom side while the bottom side 12(B) becomes its top side. As was previously noted, the ability to flip over each successive sheet implies the ability to invert the stacking sequence of a series of sheets. Thus the first side of a first sheet (e.g., sheet 12) can be made to be the "top" side of the first sheet when the stack is removed from the mechanism 10 and turned over. Each successive sheet (e.g., sheet 12') will be properly flipped over as well. Hence, the turned over stack of sheets are in their proper sequence. Such sheet turn over devices also will cause the turned over sheet to again flow in a generally rightward direction 16(R)".

Figure 11:
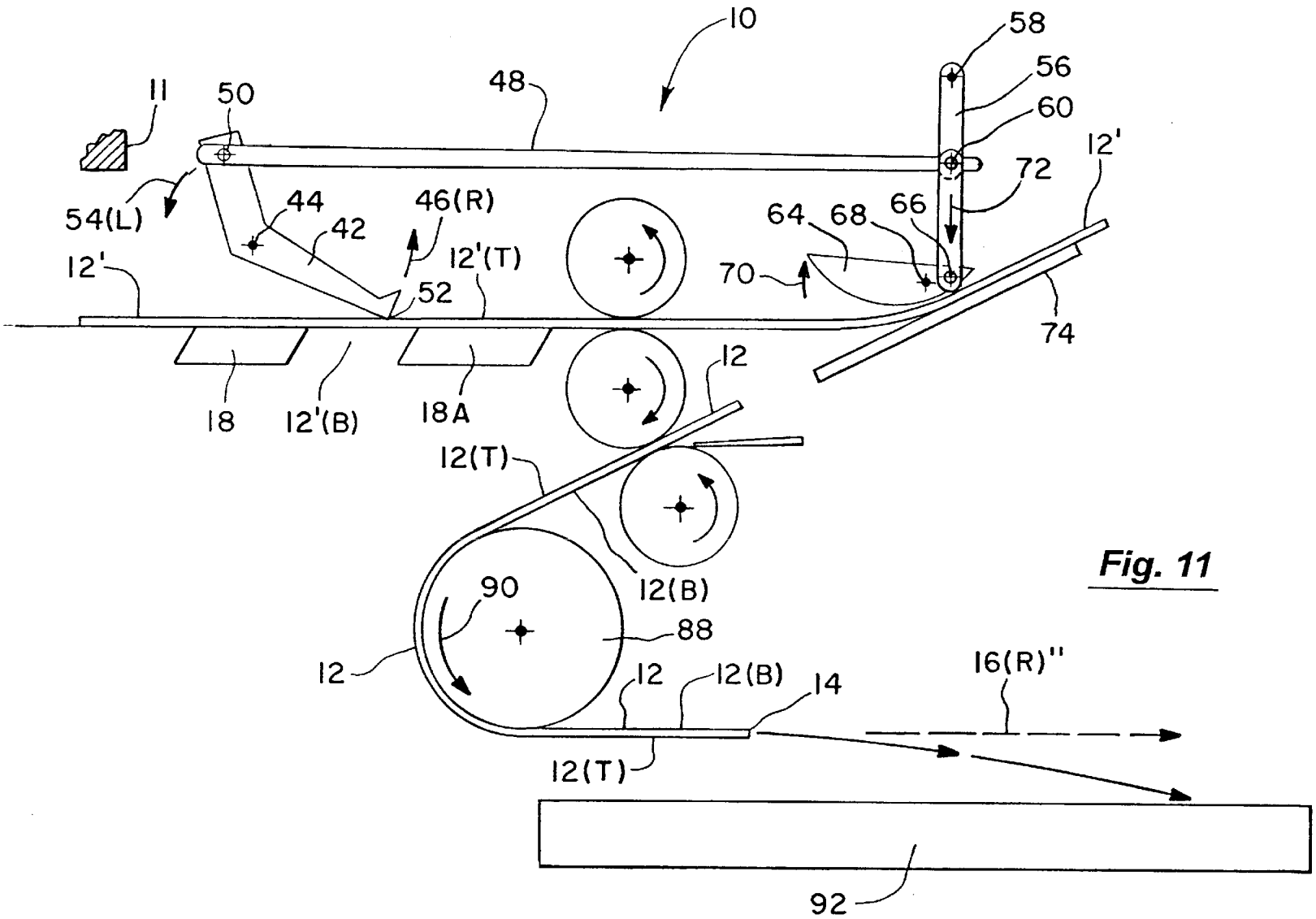
FIG. 11 is a cut-away side view of the sheet flow direction changing mechanism in an operating position wherein the mechanism is further provided with a sheet turnover device and a sheet collection tray.

FIG. 11 depicts the sheet 12 passing over the outer surface of a sheet turnover roller 88. Those skilled in this art will of course appreciate that this depiction of such a roller type sheet turnover device is highly simplified and highly generalized. Be that as it may, the sheet is turned over or "flipped over" by the roller's rotating action and association of the sheet with the rollers surface by mechanisms that are well know to those skilled in this art. Thus, the former bottom 12(B) of sheet 12 is now its top side while the former top side 12(T) is now its bottom side. Having been so turned over, the sheet 12 can be made part of a properly sequenced stack of sheets, or sent to another workstation (not shown). This outcome also is generally depicted by direction arrow 16(R)". This other workstation can be inside or outside of an overall housing (not shown) for the sheet flow direction changing mechanism 10, or a business machine with which it is associated. In the alternative, the turned over sheet 12 can be directed to a sheet collection tray 92. Here again, this sheet collection tray 92 can be inside or outside of a housing 11 for the sheet flow direction changing mechanism 10, or a business with which it is associated.

Although specific embodiments of this invention have been illustrated by the preceding drawings and discussions, it is to be understood that this was for purposes of example only. Hence, the drawings and discussions should not be construed as limiting the scope of this invention. That is to say that the hereindescribed sheet flow direction changing mechanism may be changed in various ways in order to adapt it to particular applications without departing from the scope of the following claims.

What is claimed is:

1. A sheet flow direction changing mechanism comprising:

a roller device having a first roller, a second roller and a third roller and wherein said first roller is a center roller that forms a rolling interface with the second roller and a rolling interface with the third roller;

an inclined plane that receives a sheet moving in a first direction; and a mechanically movable sheet movement stopping and buckling device that is operated by mechanical movement of the sheet and which serves to (1) stop movement of a sheet in a first direction, (2) buckle the sheet after said sheet's trailing edge is driven beyond the center roller's rolling interface with the second roller and (3) direct an unbuckling form of the sheet into the center roller's rolling interface with the third roller and thereby moving the sheet in a second direction.

2. The sheet flow direction changing mechanism of claim 1 wherein the center roller is powered and drives the second roller and the third roller.

3. The sheet flow direction changing mechanism of claim 1 wherein the second roller is mounted above the center roller in a common vertical axis and the center of the third roller is mounted below the center roller in an axis that is offset from the common vertical axis of the center roller and the second roller.

4. The sheet flow direction changing mechanism of claim 1 wherein the sheet movement stopping device is a vertical wall.

5. The sheet flow direction changing mechanism of claim 1 wherein the sheet movement stopping device is a foot that is capable of pressing downward on a sheet that lies under said foot.

6. The sheet flow direction changing mechanism of claim 1 wherein said mechanism is used in conjunction with a sheet flipping device.

7. The sheet flow direction changing mechanism of claim 1 wherein said mechanism is used in conjunction with an automated business machine selected from the group of automated business machines consisting of inkjet printers, electrophotographic printers, impact printers, copiers, facsimile machines and document scanners.

8. A sheet flow direction changing mechanism comprising:

a roller device having a first roller, a second roller and a third roller and wherein said first roller is a center roller that forms a rolling interface with the second roller that drives a sheet of paper in a first direction and a rolling interface with the third roller that drives the sheet of paper in a second direction; and a sheet movement stopping device having a foot that is raised and lowered by operation of a linkage system activated by passage of a sheet of paper under a lever arm mechanism and wherein said sheet movement stopping device is so adapted and arranged that it (1) stops movement of a sheet in the first direction, (2) assists in buckling the sheet after said sheet's trailing edge is driven beyond the center roller's rolling interface with the second roller and (3) holds down a buckled form of a sheet of paper in a manner such that the trailing edge of said sheet of paper is directed into the center roller's rolling interface with the third roller and thereby moving the sheet in a second direction; and an inclined plane for directing the sheet of paper into the center roller's rolling interface with the third roller.

9. The sheet flow direction changing mechanism of claim 8 further comprising a nip guide plate for directing the trailing edge of the sheet of paper into the rolling interface between the center roller and third roller.

10. The sheet flow direction changing mechanism of claim 8 wherein the sheet movement stopping device is a foot that is lifted from an inclined plane in order to form a gap into which a sheet of paper is inserted and then lowered into contact with said sheet in order to fix the sheet while its trailing edge is being driven downward by the center roller.

11. The sheet flow direction changing mechanism of claim 8 further comprising a pivotally mounted lever arm mechanism having a bottom end that is rotated by passing a sheet of paper under said lever arm mechanism and wherein the sheet movement stopping device is raised by means of a linkage system between said sheet movement stopping device and the lever arm mechanism.

12. The sheet flow direction changing mechanism of claim 8 further comprising a pivotally mounted lever arm mechanism having a top end that is connected to a connector rod that pulls a linkage system toward the lever arm mechanism when said mechanism is rotated by passage of a sheet of paper thereunder.

13. The sheet flow direction changing mechanism of claim 8 wherein said mechanism further comprises an inclined plane against which the foot presses a sheet of paper in order to fix said sheet so that it can be buckled.

14. The sheet flow direction changing mechanism of claim 8 wherein said mechanism further comprises a nip guide plate that serves to direct a sheet of paper into the center roller's interface with the third roller.

15. The sheet flow direction changing mechanism of claim 8 further comprising a first guide plate and a second guide plate that are separated by a space in which a bottom end of a lever arm mechanism resides when the sheet flow direction changing mechanism is in a first operating position.

16. The sheet flow direction changing mechanism of claim 8 further comprising a first guide plate and a second guide plate that are separated by a space from which a bottom end of a lever arm mechanism is driven when a sheet of paper bridges the space between the first and second guide plates.

17. The sheet flow direction changing mechanism of claim 8 further comprising a sheet turnover device.

18. The sheet flow direction changing mechanism of claim 8 further comprising a roller type sheet turnover device.

19. A sheet flow direction changing mechanism comprising:

a roller device having a first roller, a second roller and a third roller and wherein (1) said first roller is a powered center roller that forms a rolling interface with the second roller and a rolling interface with the third roller, (2) the first, second and third rollers are of the same diameter and (3) the first roller and the second roller have a common center line while the third roller has a center line that is offset from the common center line of the first and second rollers; and a sheet movement stopping device having a foot that is capable of being raised and lowered by operation of a mechanical linkage system activated by passage of a sheet of paper under a lever arm mechanism and wherein said sheet movement stopping device is so adapted and arranged that it (1) stops movement of the sheet of paper in a first direction, (2) assists in buckling the sheet of paper when said sheet's trailing edge comes into contact with a rotating outside surface of the center roller, (3) holds down a buckled form of the sheet of paper in a manner such that the trailing edge of said sheet of paper is directed into the rolling interface between the center roller and third roller when said sheet of paper unbuckles and thereby directing said sheet of paper in a second direction and (4) is capable of passing an upward moving second sheet and a downward moving first sheet; and an inclined plane for directing the sheet of paper into the rolling interface contact between the center roller and third roller.

* * * * *